United States Patent [19]

Abrial

[11] 4,045,168

[45] Aug. 30, 1977

[54] DEVICE FOR MOUNTING PANELS OF FIBROUS REFRACTORY MATERIAL

[75] Inventor: Lucien Abrial, Firminy, France

[73] Assignee: Creusot-Loire, Paris-Cedex, France

[21] Appl. No.: 654,006

[22] Filed: Jan. 30, 1976

[30] Foreign Application Priority Data

| | | |
|---|---|---|
| Feb. 26, 1975 | France | 75.05923 |
| Oct. 17, 1975 | France | 75.31909 |

[51] Int. Cl.[2] ..... F27D 1/00

[52] U.S. Cl. ..... 432/247; 110/1 A; 52/506; 52/513

[58] Field of Search ..... 432/247, 248, 252; 110/1 A; 52/506, 513, 232

[56] References Cited

U.S. PATENT DOCUMENTS

| | | | |
|---|---|---|---|
| 2,021,610 | 11/1935 | Quint | 110/1 A |
| 2,164,322 | 7/1939 | Hahn | 52/506 |
| 2,207,897 | 7/1940 | Schans | 52/513 |
| 3,383,820 | 5/1968 | Kates | 52/506 |
| 3,786,605 | 1/1974 | Winfrey | 52/513 |
| 3,909,907 | 10/1975 | Davis | 110/1 A |

FOREIGN PATENT DOCUMENTS

| | | | |
|---|---|---|---|
| 229,782 | 10/1963 | Austria | 432/247 |
| 768,114 | 7/1934 | France | 432/252 |

*Primary Examiner*—John J. Camby
*Assistant Examiner*—Henry C. Yuen

[57] ABSTRACT

A device for mounting panels of fibrous refractory material against the inner surface of the wall of an industrial furnace, comprising a plug of refractory material in the form of a bolt with a square head and a non-threaded cylindrical shank provided with a plurality of circular ribs arranged in planes perpendicular to the axis of the plug, the panels to be attached thereby having spaced-apart apertures of dimensions intermediate those of the head and of the ribs on the shank, and the wall of the furnace having corresponding cavities filled with a sealing material and for receiving the shank of the plug.

5 Claims, 6 Drawing Figures

DEVICE FOR MOUNTING PANELS OF FIBROUS REFRACTORY MATERIAL

The present invention concerns the mounting of panels of fibrous refractory material inside industrial furnaces.

Reduction of the thermal inertia of furnaces in order to achieve economy of energy has been made possible by the use of fibrous refractory material which is very light and resistant to very high temperatures.

The technique of internally cladding the walls of industrial furnaces with fibrous refractory material is at present very common and is applied by numerous users.

Panels of fibrous refractory material of about 1 $m^2$ are attached to the interior of the furnace by metal rods of refractory steel passing through the thickness of the furnace walls and spaced apart by about 200 to 300 mm. FIG. 1 of the accompanying drawings shows such a known method of attachment. Metal rods 1, of refractory steel, tightened by nuts 2, clamp fibrous refractory panels 3 against a furnace wall 4 which consists of brick or concrete or any other refractory material.

This first known method of attachment is suitable for furnaces operating at relatively low temperatures, less than 1000° C, being a temperature at which the refractory steels have acceptable mechanical strength. But it is not possible to employ this mounting technique when temperatures are higher (above 1000° C) because the rods of refractory steel are then rapidly destroyed.

Another known technique enables this difficulty to be overcome by using bricks prefabricated from fibrous refractory material and spacing the anchoring heads of the rods from the hot inside surface of the wall of the furnace, so that a lower acceptable temperature obtains at the level of the metal rods.

FIG. 2 shows this second known method of attachment employable in high-temperature furnaces. Fibrous refractory bricks 5 are prefabricated in a special form to provide an internal cavity 9. These bricks are attached to a furnace wall 6 by means of metal rods 7 which pass through the thickness of the furnace wall 6 and into the cavity 9 of the bricks so that anchoring heads 8 of the rods 7, located in the cavities 9 in the bricks 5, are suitably protected against too high temperature. As in the previous method these metal rods 7 are tightened up by nuts 10 against the outer face of the furnace wall.

While this second known method may satisfactorily solve the problem of high-temperature furnaces, it has the disadvantage of being expensive because the bricks are costly, and it also has the disadvantage of requiring a relative large thickness of the fibrous refractory material.

According to the present invention there is provided a device for mounting panels of fibrous refractory material inside an industrial furnace, the device comprising a plug of refractory material having the form of a bolt with a square head and a non-threaded cylindrical shank provided with a plurality of circular ribs, arranged in planes perpendicular to the axis of the plug, the panels to be attached thereby having spaced-apart apertures of dimensions intermediate those of the head and of the ribs on the shank, and the wall of the furnace having corresponding cavities filled with a sealing material and for receiving the shank of the plug. The plug is preferably made of a silicoaluminous material.

In certain cases it may be desirable to avoid locking the refractory panels between the heads of the plugs and the sealing product without leaving any play in these panels. If locking occurs, because retraction from heating cannot properly occur, cracks may be produced in a panel between the fixing plugs, reducing the working life of the panel. To avoid this, two washers of cardboard or any other combustible material may be arranged round each plug. The washers are intended to be burnt and eliminated at the first heating. One of the combustible washers is arranged between the head of the plug and the refractory panel to be attached thereby, and the other washer has a height substantially equal to the thickness of the panel, lines the inside of the aperture in the panel into which the plug is introduced, and consequently surrounds a portion of the shank of the plug adjacent its head.

Advantageously the height of the one washer is between 1.5 mm and 3 mm and is preferably of the order of 2 mm. The thickness of the wall of the other washer is preferably between 3 mm and 8 mm and preferably of the order of 5 mm.

As will be understood, one of the main advantages of the invention consists in replacing a metal fixing member by a fixing member of refractory material, which avoids all the disadvantages of metal fixing members at high temperatures.

Placing the refractory plugs into a sealing part does not produce any practical difficulties and is not costly.

Finally, reasonably priced fibrous refractory panels can be employed, prefabricated shaped parts of fibrous refractory being unnecessary.

The advantage of providing the two washers of combustible material is that after combustion and elimination of the two washers, the refractory panels are not clamped between the furnace wall and the heads of the plugs, and are thus able to slide easily, and a convenient clearance exists between the panels and the shanks of the plugs.

The present invention will be more fully understood from the following description of two embodiments thereof, given by way of example only.

In the accompanying drawings.

Figure 1:
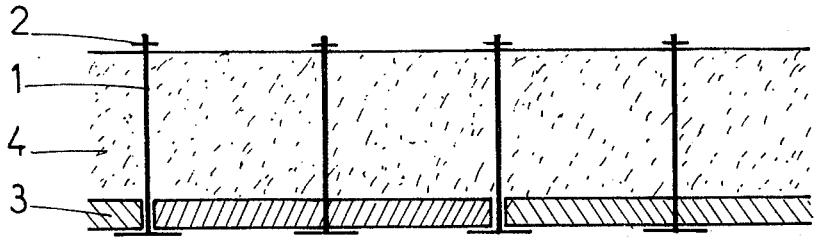
FIG 1 PRIOR ART
FIG. 1 illustrates a known method of attaching panels of fibrous refractory material to the interior of a furnace.
Figure 2:
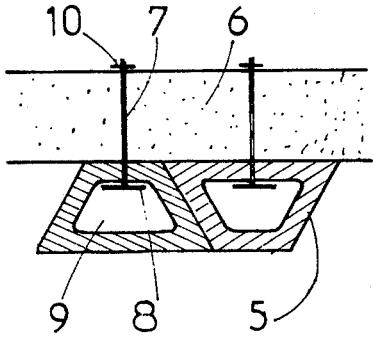
FIG 2 PRIOR ART
FIG. 2 shows another known method of attachment that is employable in high-temperature furnaces.

FIGS. 1 and 2, relating to the prior art, were described earlier, in the introduction.

Figure 3:
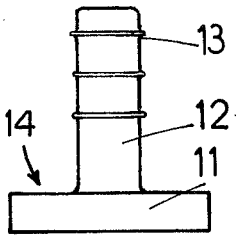
FIG. 3 is an elevation of an embodiment of a device in accordance with the invention.

As shown in FIG. 3 the device comprises a plug 14 of silico-aluminous refractory material in the form of a bolt having a square head 11 and a cylindrical shank 12 furnished with circular ribs 13 located in planes perpendicular to the axis of the shank 12.

Figure 4:
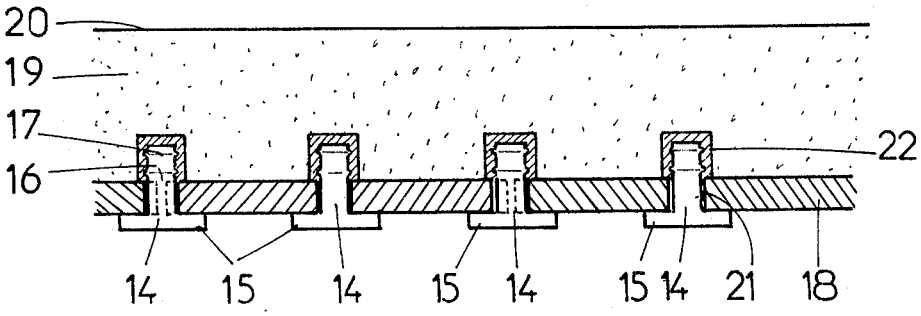
FIG. 4 illustrates a method of attachment of panels by means of a number of devices identical with that shown in FIG. 3.

A plurality of plugs 14 similar to that of FIG. 3, with square heads 15 and cylindrical shanks 16 provided with ribs 17, is shown in FIG. 4.

For attaching panels 18 of fibrous refractory material against a wall 19 of a furnace, the wall being made of bricks or concrete or any other refractory material bounded externally by sheet metal 20, the panels 18 are provided with spaced apertures 21 into which the plugs 14 are introduced.

Opposite each aperture 21 the wall 19 of the furnace has cavities 22 filled with a material. At the time of construction of the wall, a sealing material is introduced into each cavity 22 and immediately afterwards a plug 14 is introduced. The ribs 17 of the plugs enable excellent sealing of each plug 14 in the cavity 22 to be achieved.

Figure 5:
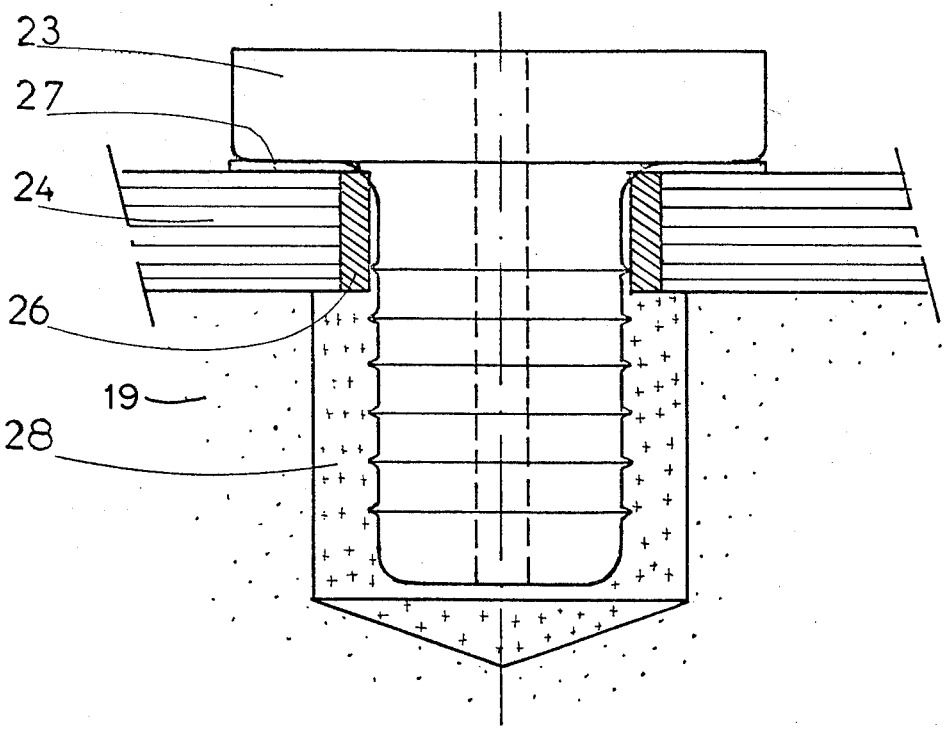
FIG. 5 is an axial section through a device including two cardboard washers in accordance with the invention.

A second embodiment is illustrated in FIG. 5 and has the form of a plug having a head 23, of silico-aluminous refractory material. As illustrated the plug 23 is employed for fixing a panel 24 of fibrous refractory material against the wall 19 of a furnace. This plug 23 has a square head 120 mm by 120 mm and a cylindrical shank of 52 mm in diameter having ribs whose outer diameter is 56 mm. The plug is centrally pierced by a cylindrical channel of diameter 10 mm which may be employed for injecting the sealing material into a wall cavity 28, which is however not essential.

This channel is also useful likewise for unsealing the plug in the rare event of its head breaking.

In this embodiment the device includes a first cylindrical washer 26 of cardboard which lines the inside of the aperture in the panel into which the plug is introduced; this washer has an outer diameter of 66 mm and an inner diameter of 56 mm with a wall thickness of 5 mm, and its length is equal to the thickness of the panel to be attached, or 25 mm in the present example.

Another cardboard washer 27 is arranged between the head of the plug 23 and the panel 24 to be attached. This washer consists of a square disc of 120 mm by 120 mm with a hole of diameter 58 mm. Its thickness is 2 mm.

In mounting the panel 24 using the plug 23, the cavity 28 receives a sealing material and immediately afterwards the washer 26 is introduced, then the washer 27 and finally the plug 23.

Figure 6:
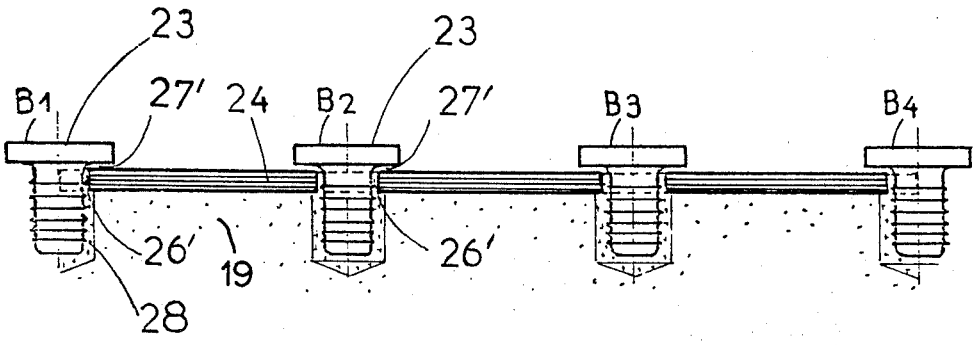
FIG. 6 is a section through a row of devices as shown in FIG. 5 after heating of the furnace and hence after combustion of the two cardboard washers.

FIG. 6 shows a row of fixing plugs $B_1$ to $B_4$ of a panel 24 after firing, that is to say, after combustion of the two cardboard washers. There then exists a clearance 26' instead of the washer 26 and a clearance 27' instead of the washer 27. The furnace wall is schematically shown at 19.

After combustion of the two cardboard washers and their elimination at the first heating, the panel 24 has sufficient play available to it to avoid any risk of cracking.

It should be understood that the exemplary, known metal rods 1 and 7 of FIGS. 1 and 2, respectively, are similar. The same applies to the known nuts 2 and 10, respectively. While the known panels are identified by numeral 3, in the inventive embodiments of the device these are designated by numerals 18 and 24. The furnace wall appears with numbers 4 and 6 in the known embodiments, and with numeral 19 in FIGS. 4 through 6 that illustrate the invention. The inventive plugs are designated in FIGS. 3 and 4 with numeral 14, and also correspond to the designations $B_1$ through $B_4$ in FIG. 6. Finally, the heads of these plugs are designated in FIGS. 3 through 6 with the numerals 11, 15 and 23, as will be understood when comparing the various inventive embodiments with each other.

There are thus provided mounting devices which are suitable for high-temperature furnaces but are yet much cheaper than the known mounting means.

What is claimed is:

1. A device for mounting panels of fibrous refractory material of a predetermined thickness against a wall of an industrial furnace, the device comprising:

a plug of refractory material having the form of a bolt with a square head and a non-threaded cylindrical shank provided with a plurality of circular ribs, said plug having an axis arranged in planes perpendicular to the axis of said plug, the panels to be attached thereby having spaced-apart apertures of dimensions intermediate those of said head and of said ribs on the shank, and the wall of the furnace having corresponding cavities filled with a sealing material and for receiving said shank of the plug; and two washers of combustible material, which are to be burned in the furnace and thereby eliminated at the first heating, one of said washers being adapted to be arranged between said head of the plug and the refractory panel to be mounted by said plug, the other of said washers having a height substantially equal to the thickness of the panel, and being adapted to line the apertures in the panel into which said plug is introduced and consequently surround a portion of said shank of the plug adjacent said head.

2. The device as defined in claim 1, wherein the material of said refractory plug is a silico-aluminous material.

3. The device as defined in claim 1, wherein the wall thickness of said other washer is between 3 and 8 millimeters.

4. The device as defined in claim 1, wherein the height of said one washer is between 1.5 and 3 mm.

5. The device as defined in claim 4, wherein the wall thickness of said other washer is of the order of approximately 5 mm.

* * * * *